US010414474B2

(12) United States Patent
Place

(10) Patent No.: US 10,414,474 B2
(45) Date of Patent: Sep. 17, 2019

(54) BOAT HANDLING APPARATUS

(71) Applicant: Dale David Place, Selkirk (CA)

(72) Inventor: Dale David Place, Selkirk (CA)

( * ) Notice: Subject to any disclaimer, the term of this patent is extended or adjusted under 35 U.S.C. 154(b) by 0 days.

(21) Appl. No.: 15/262,147

(22) Filed: Sep. 12, 2016

(65) Prior Publication Data

US 2017/0096202 A1 Apr. 6, 2017

(30) Foreign Application Priority Data

Oct. 6, 2015 (CA) ..... 2907325

(51) Int. Cl.

| | |
|---|---|
| ***B63C 3/08*** | (2006.01) |
| ***B63C 3/06*** | (2006.01) |
| ***B63C 3/12*** | (2006.01) |
| *B63C 15/00* | (2006.01) |

(52) U.S. Cl.

CPC ..... *B63C 3/08* (2013.01); *B63C 3/06* (2013.01); *B63C 3/12* (2013.01); *B63C 15/00* (2013.01)

(58) Field of Classification Search

USPC ..... 405/1–3

See application file for complete search history.

(56) References Cited

U.S. PATENT DOCUMENTS

| | | | | |
|---|---|---|---|---|
| 4,797,055 A * | 1/1989 | Tworoger | B63C 3/06 | 187/234 |
| 5,326,217 A * | 7/1994 | Simpson | B66F 9/08 | 187/226 |
| 6,003,463 A * | 12/1999 | Giesler | B63B 23/32 | 114/259 |
| 6,591,770 B1 * | 7/2003 | Blackmore | B63B 27/36 | 114/259 |
| 2008/0095578 A1 * | 4/2008 | Farber | B60P 3/10 | 405/3 |

FOREIGN PATENT DOCUMENTS

FR 2870205 A1 * 11/2005 ..... B63C 3/12

* cited by examiner

*Primary Examiner* — Kyle Armstrong
(74) *Attorney, Agent, or Firm* — Ryan W. Dupuis; Ade + Company Inc.; Kyle R. Satterthwaiter

(57) ABSTRACT

A boat handling apparatus includes a carriage frame supported for rolling movement along a first horizontal track between a lifting position adjacent to a first end of the first track and a stored position adjacent to an opposing second end of the first track. A second upright track is fixed in proximity to the first end of the first track to depend downwardly from the first track. A cradle frame which is arranged to support a boat thereon is transferrable from a raised position supported on the carriage frame so as to be movable with the carriage frame between lifting and storage positions thereof, to a lowered position in which the cradle frame is movable up and down along the second track below the first horizontal track.

16 Claims, 12 Drawing Sheets

BOAT HANDLING APPARATUS

This application claims foreign priority benefits from Canadian Patent Application 2,907,325, filed Oct. 6, 2015, the contents of which are incorporated herein by reference.

FIELD OF THE INVENTION

The present invention relates to a boat handling apparatus for lifting a boat from the water and moving the boat away from the water to a storage location, and more particularly the present invention relates to a boat handling apparatus which includes i) a cradle frame arranged to support a boat thereon, ii) a carriage assembly which supports the cradle frame thereon for translating movement of the boat along a first track, and iii) a depending second track supported at one end of the first track onto which the cradle frame can be transferred for lifting the cradle frame from water level to the carriage frame on the first track above the water level.

BACKGROUND

Various devices are known for handling boats, and more specifically for lifting both in and out of the water. In the simplest form of a boat lift, a ramp is provided at the shoreline of a body of water, and a trolley is supported for movement along the ramp which includes a cradle thereon upon which a boat can be supported. Use of a ramp however is limited to areas where the shoreline elevates gradually.

Other examples of boat lifts simply lift the boat vertically out of the water, however only limited protection can be offered to the boat when suspending the boat over the body of water. Some vertically lifting boat lifts to permit the boat to also be horizontally displaced, however such horizontal displacement is typically limited to a pivotal movement about a vertical sliding axis of the boat lift such that the horizontal distance that the boat can be displaced is limited by the pivotal range of movement of the mechanism such that protection of the boat from the body of water remains limited.

SUMMARY OF THE INVENTION

According to one aspect of the invention there is provided a boat handling apparatus comprising:

a first track extending in a longitudinal direction between a first end and a second end which is spaced apart in a horizontal direction from the first end;

a carriage frame supported on the first track so as to be movable along the first track in the longitudinal direction between a lifting position adjacent to the first end and a stored position spaced along the first track from the first end of the first track;

a second track which is upright in orientation and in proximity to the first end of the first track to depend downwardly from the first track; and a cradle frame arranged to support a boat thereon, the cradle frame being movable along the second track from a lowered position spaced below the first track to a raised position supported on the carriage frame above the second track when the carriage frame is in the lifting position at the first end of the first track.

By providing a frame which can be both vertically displaced along a second track and horizontally displaced along a first track, a boat lift is provided which can lift the boat a considerable vertical distance so as to be suitable for steep shorelines, while simultaneously enabling the boat to be displaced a considerable horizontal distance to be safely sheltered from any violent weather near the body of water.

Preferably the apparatus further includes a third track supported on the carriage frame in an upright orientation in alignment with the second track in the lifting position of the carriage frame, such that the cradle frame is transferrable from the second track to the first track as the cradle frame is displaced from the lowered position to the raised position.

Preferably a retractable drive element is coupled between the cradle frame and the carriage frame to suspend the cradle frame from the carriage frame in the lower position of the cradle frame on the second track.

Preferably a lift motor supported on the carriage frame and operatively connected to the retractable drive element so as to raise and lower the cradle frame along the second track by retracting the retractable drive element.

The cradle frame may comprises i) an upright frame portion supporting lift wheels thereon in rolling engagement along the second track and ii) a supporting portion extending generally horizontally outwardly from the upright frame portion, away from the first track, in proximity to a bottom end of the upright frame portion. Preferably the supporting portion defines a cradle arranged to support a boat thereon.

When carriage wheels are supported on the carriage frame in rolling engagement along the first track, a carriage motor may be supported on the carriage frame which is operatively connected to at least one of the carriage wheels so as to displace the carriage frame along the first track by driving rotation of said at least one of the carriage wheels.

The apparatus may further include i) a drive shaft supported on the carriage frame so as to be driven to rotate by the carriage motor and ii) a pair of laterally spaced apart driving members supported on the drive shaft for rotation with the shaft relative to the carriage frame in which the driving members are operatively connected to respective ones of the carriage wheels at laterally opposing sides of the carriage frame.

Preferably the second track is mounted in fixed relation to the first track.

The carriage frame may further comprise: i) a lower frame supporting carriage wheels thereon in rolling engagement along the first track; ii) an upper frame arranged to receive the cradle frame supported thereon in the raised position; and iii) an intermediate frame supporting the upper frame spaced above the lower frame which comprises two laterally spaced apart side frame portions, each side frame portion lying substantially in a respective upright plane which is parallel to the longitudinal direction of the first track. Preferably the intermediate frame consists solely of the two side frame portions in which each side frame portion consists of a plate member which is upright and parallel to the longitudinal direction of the first track. Preferably a carriage motor is supported on the upper frame of the carriage frame which is operatively connected to at least one of the carriage wheels so as to displace the carriage frame along the first track by driving rotation of said at least one of the carriage wheels. The carriage motor may be operatively connected to said at least one of the carriage wheels by a chain which is supported to be co-planar with one of the side frame portions.

When the apparatus is used in combination with a deck surface comprising a plurality of deck boards extending in the longitudinal direction above the first track so as to define longitudinally extending slots in the deck surface between adjacent ones of the deck boards, preferably i) the lower frame is below the deck surface, ii) the upper frame is above the deck surface and iii) the side frame portions of the intermediate frame extend upwardly from the lower frame to the upper frame through respective ones of the longitudinally extending slots in the deck surface.

According to a second aspect of the present invention there is provided a boat handling apparatus comprising:

a track extending in a longitudinal direction between a first end and a second end which is spaced apart in a horizontal direction from the first end;

a supporting floor surface supported above the track and locating a pair of longitudinal slots therein extending in the longitudinal direction along a length of the track at laterally spaced apart locations; and a carriage frame supported on the track so as to be movable along the track in the longitudinal direction between a first position adjacent to the first end and a second position spaced along the first track from the first end of the first track;

the carriage frame further comprising:

a lower frame below the supporting floor surface supporting carriage wheels thereon in rolling engagement along the first track, an upper frame above the supporting floor surface and supporting a cradle frame thereon which is arranged to support a boat thereon; and an intermediate frame supporting the upper frame spaced above the lower frame, the intermediate frame comprising two laterally spaced apart side frame portions extending upwardly through respective ones of the longitudinal slots in the floor supporting surface for sliding movement along the longitudinal slots between the first and second positions of the carriage frame along the track.

The arrangement of an intermediate frame received within longitudinal slots in a floor supporting surface allows the components of the track and the carriage wheels on the lower frame to be concealed below the floor supporting surface for maximizing storage options of the floor supporting surface while being more aesthetically pleasing at the same time. The carriage frame may be used together with a second vertical track as described above, or alternatively the carriage frame may be simply displaced along a ramp extending from the first track to lower the boat into the body of water.

The intermediate frame may consist solely of the two side frame portions, in which each side frame portion consist of a plate member which is upright and parallel to the longitudinal direction of the track.

A carriage motor may be supported on the upper frame of the carriage frame which is operatively connected to at least one of the carriage wheels so as to displace the carriage frame along the track by driving rotation of said at least one of the carriage wheels. The carriage motor may be operatively connected to said at least one of the carriage wheels by a chain which is supported to be co-planar with one of the side frame portions.

The supporting floor surface may comprise a deck surface formed of a plurality of deck boards extending in the longitudinal direction above the track so as to define longitudinally extending slots in the deck surface between adjacent ones of the deck boards. In this instance, the lower frame is preferably below the deck surface, the upper frame is preferably above the deck surface, and the side frame portions of the intermediate frame preferably extend upwardly from the lower frame to the upper frame through respective ones of the longitudinally extending slots in the deck surface.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
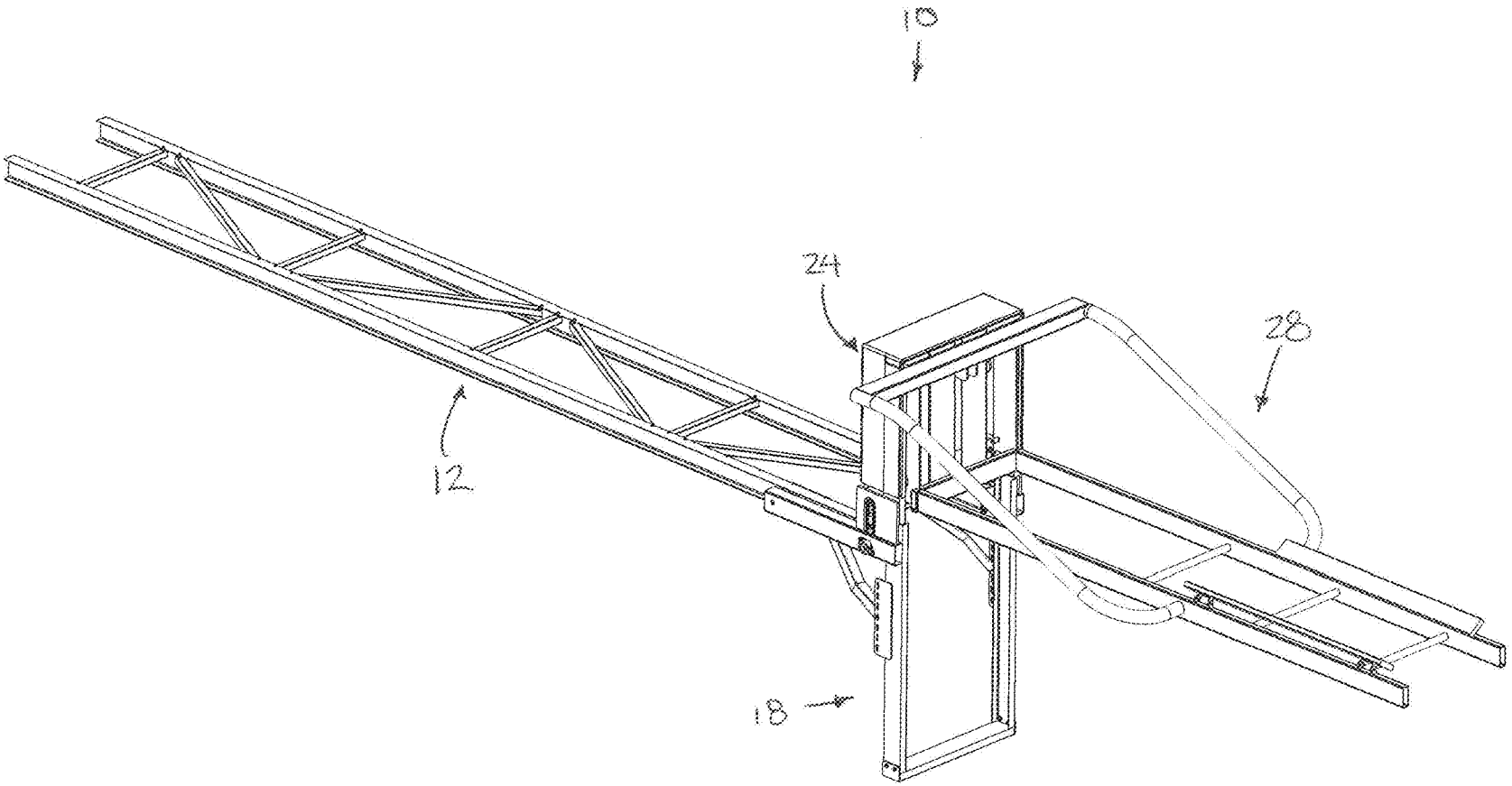
FIG. 1 is a perspective view of the boat handling apparatus.
Figure 2:
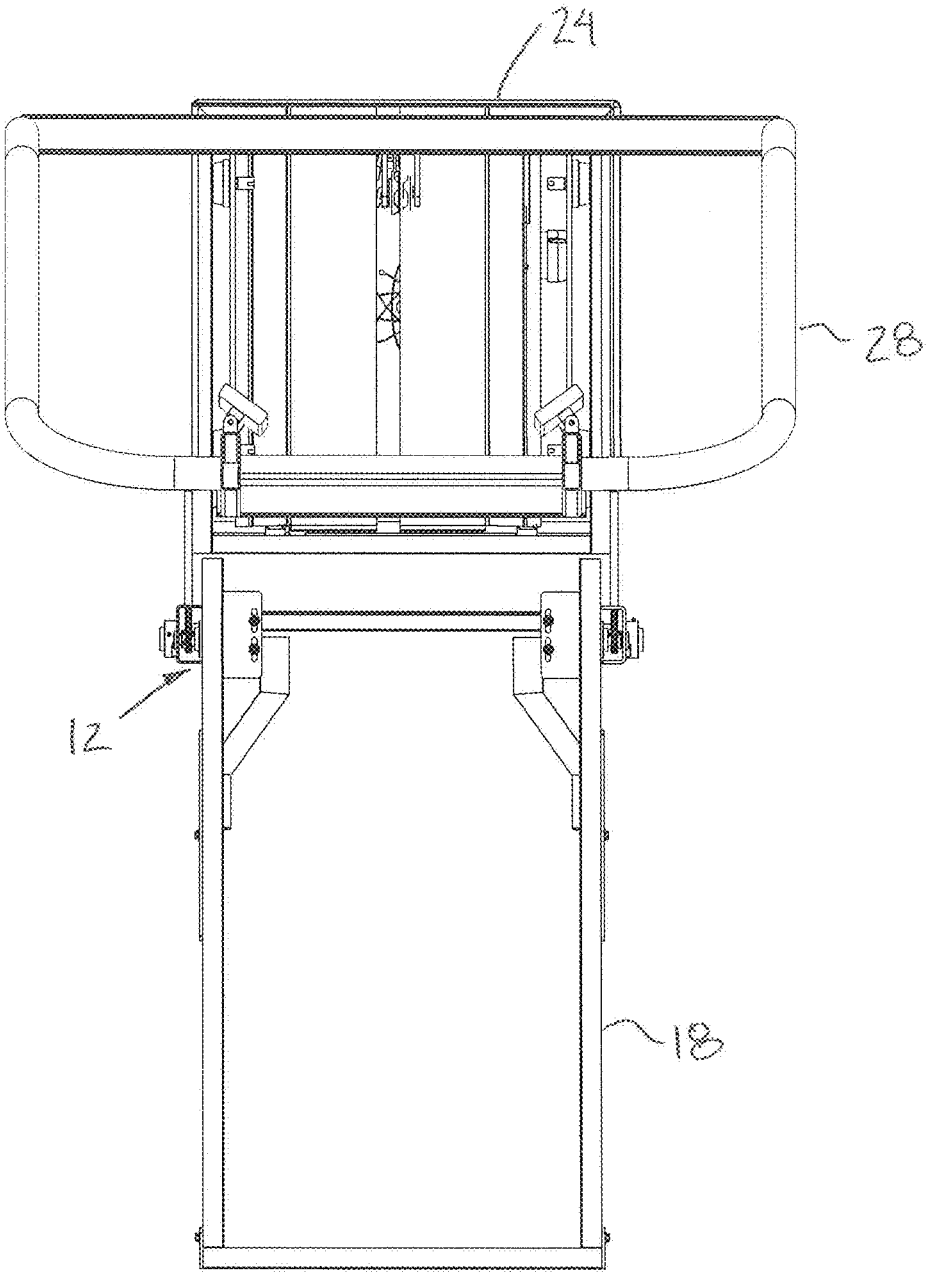
FIG. 2 is an outer end elevational view of the boat handling apparatus.
Figure 3:
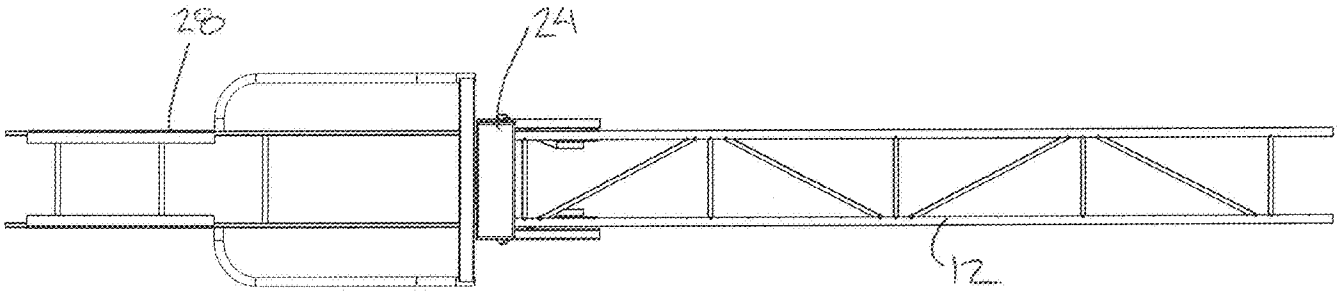
FIG. 3 is a top plan view of the boat handling apparatus.
Figure 4:
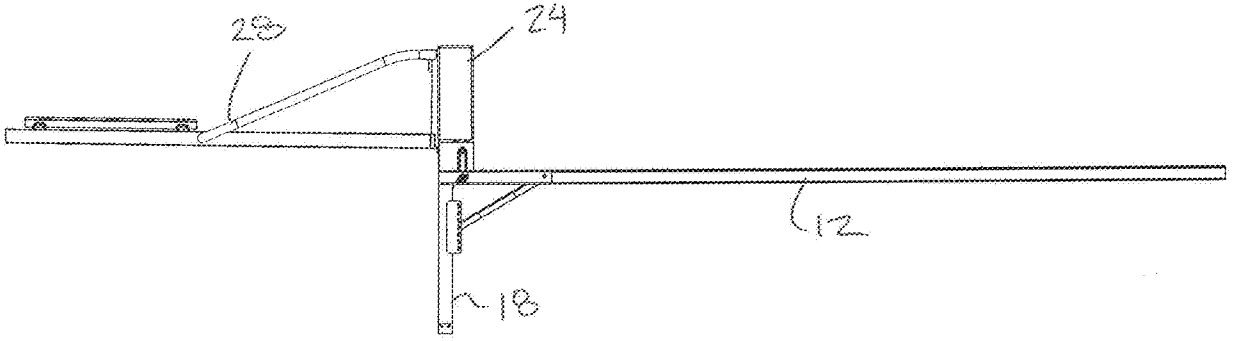
FIG. 4 is a side elevational view of the boat handling apparatus.
Figure 5:
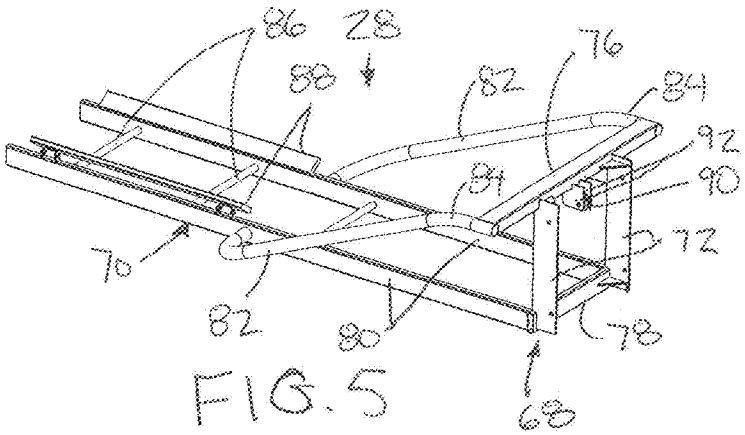
FIG. 5 is a perspective view of the cradle frame according to the apparatus of FIG. 1.
Figure 8:
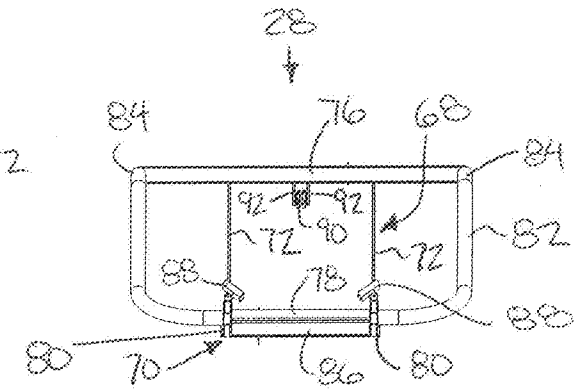
FIGS. 6, 7 and 8 are side elevational, top plan, and outer end elevational views respectively of the cradle frame.
Figure 6:
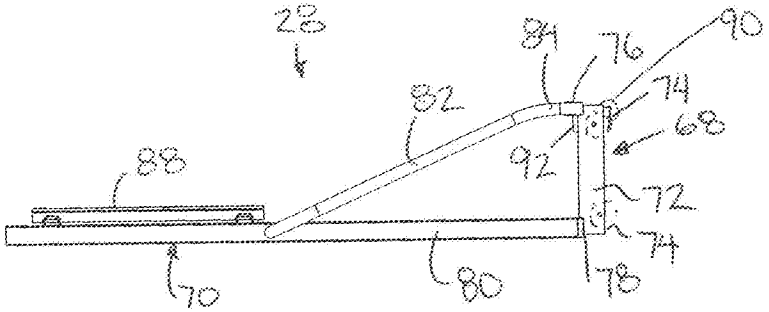
Figure 7:
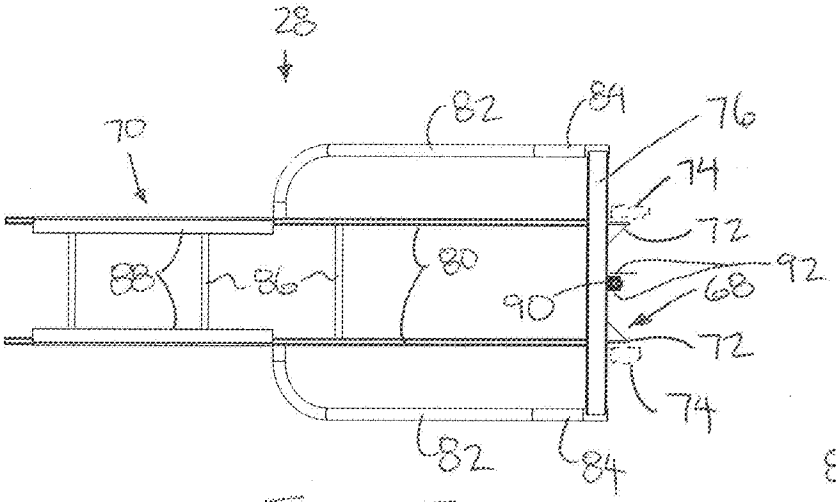
Figure 9:
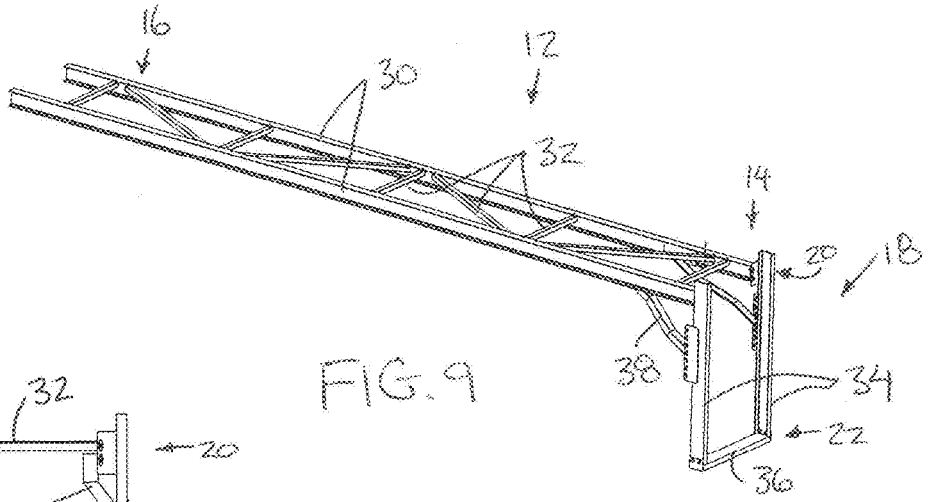
FIG. 9 is a perspective view of the first and second tracks of the apparatus according to FIG. 1.
Figure 12:
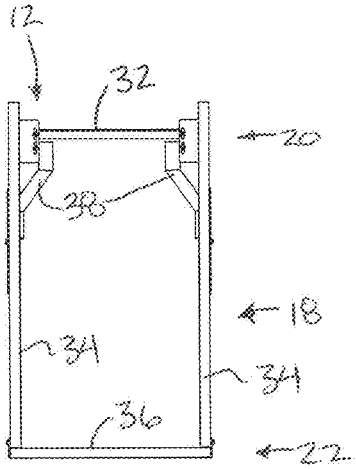
FIGS. 10, 11 and 12 are side elevational, top plan, and outer end elevational views respectively of the first and second tracks.
Figure 10:
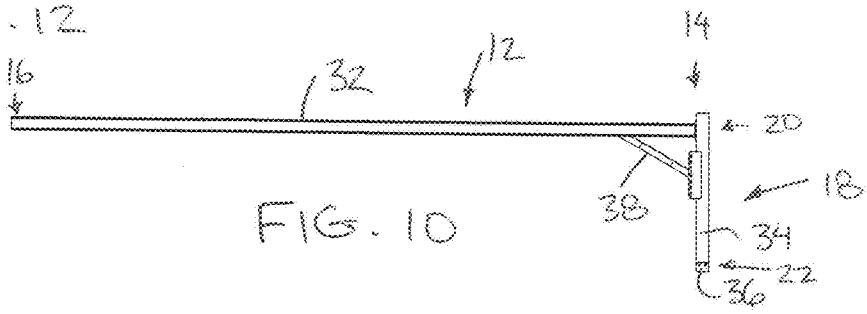
Figure 11:
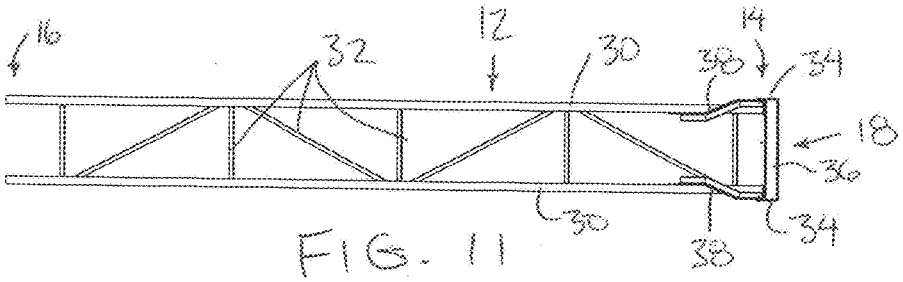
Figure 13:
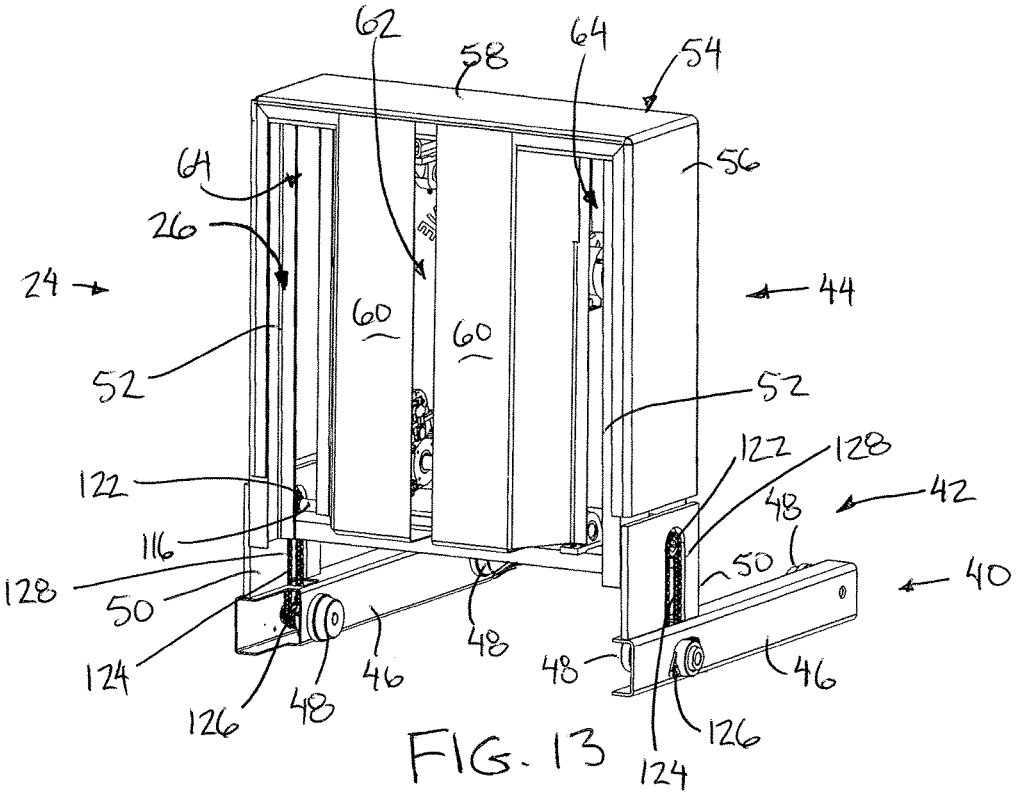
FIG. 13 is a perspective view of the carriage frame according to the apparatus of FIG. 1.
Figure 14:
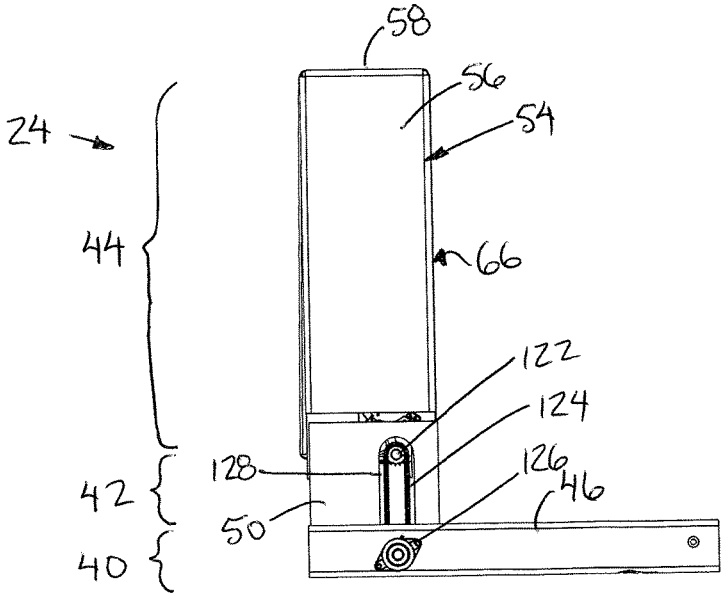
FIGS. 14, 15 and 16 are side elevational, outer end elevational, and top plan views respectively of the carriage frame.
Figure 15:
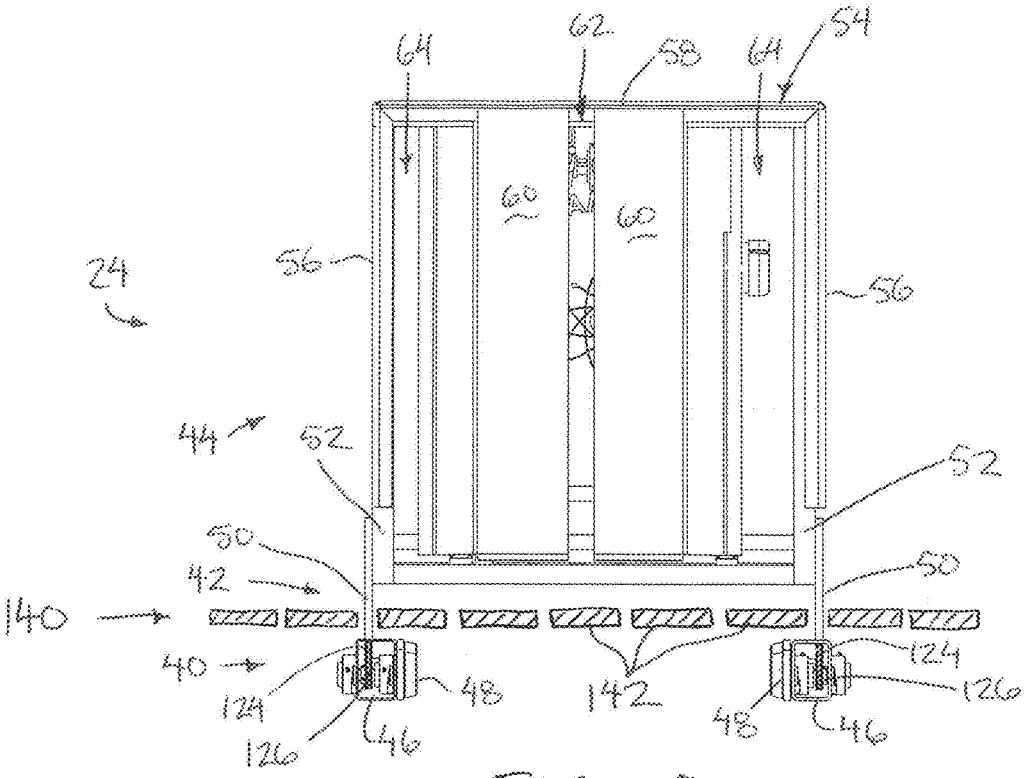
Figure 16:
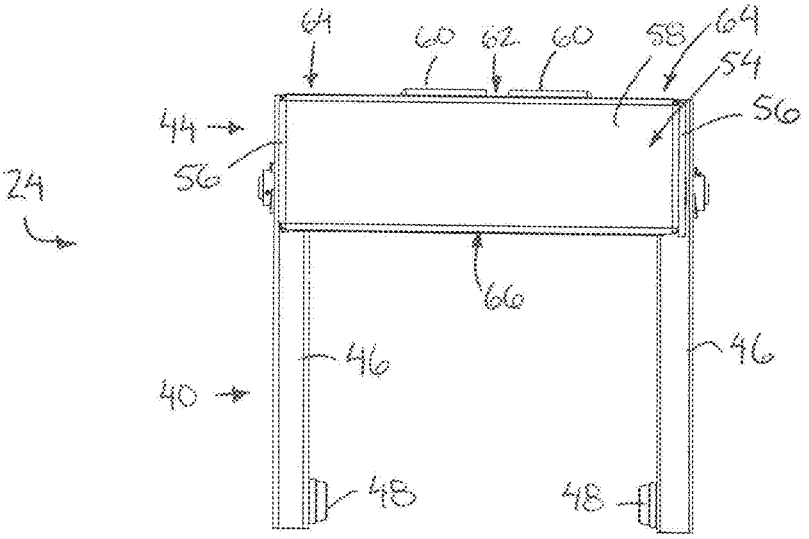
Figure 17:
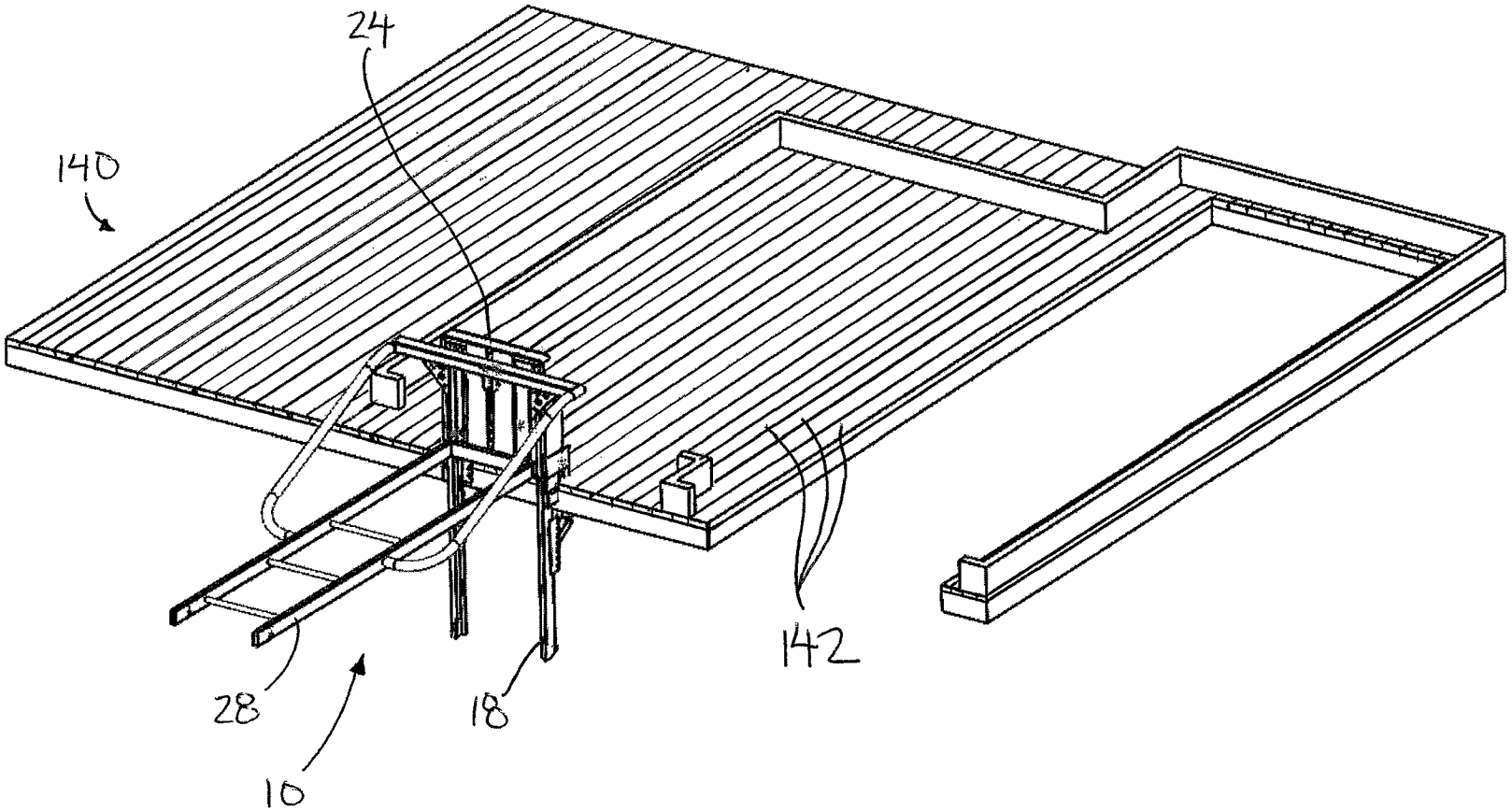
FIG. 17 is a perspective view of one exemplary embodiment of the boat handling apparatus.
Figure 18:
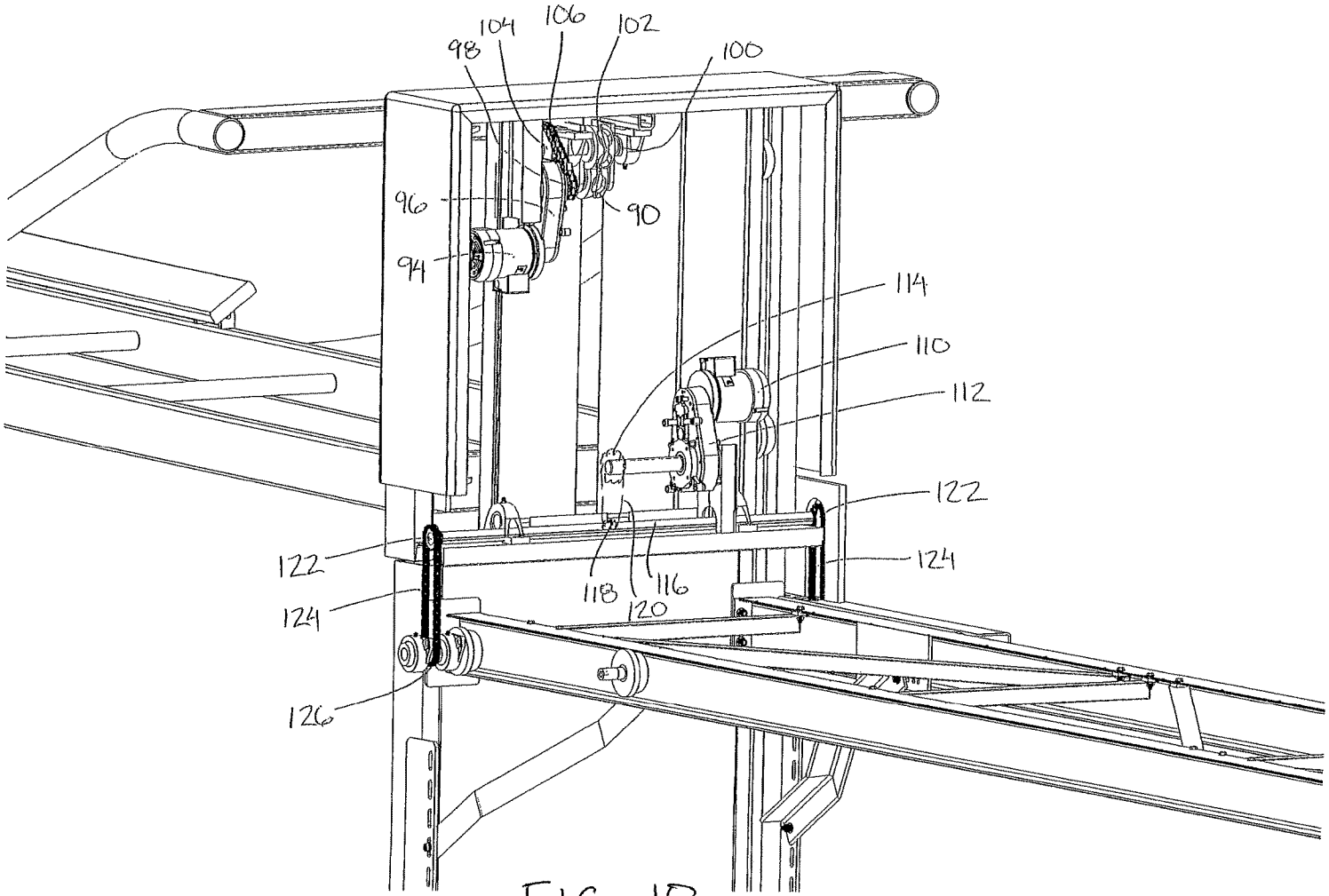
FIG. 18 is a perspective view of the boat handling apparatus with some components of the carriage frame removed to illustrate the lift motor and the carriage motor respectively.
Figure 19:
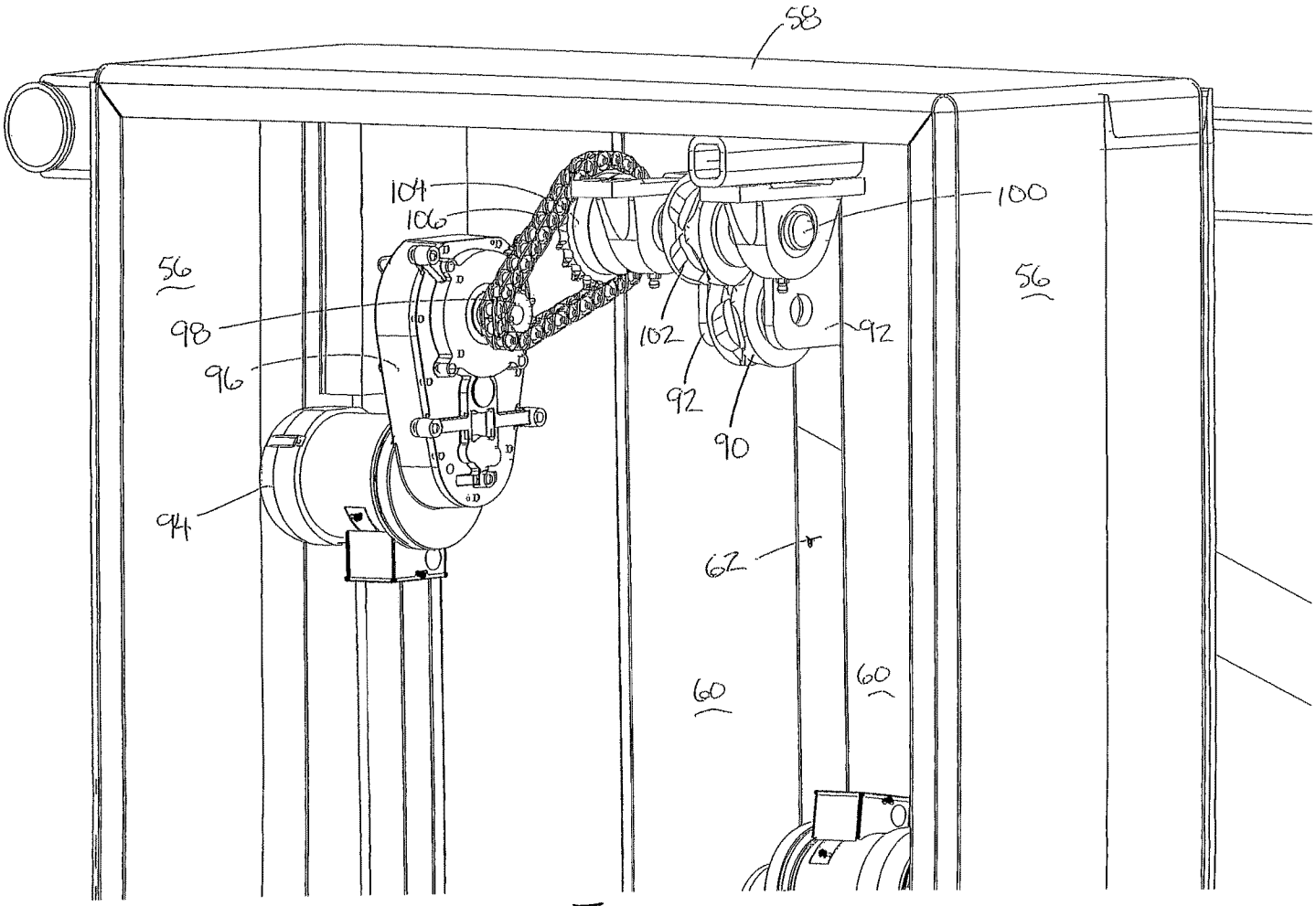
FIG. 19 is an enlarged perspective view of components of the lift mechanism of the boat handling apparatus of FIG. 1.
Figure 20:
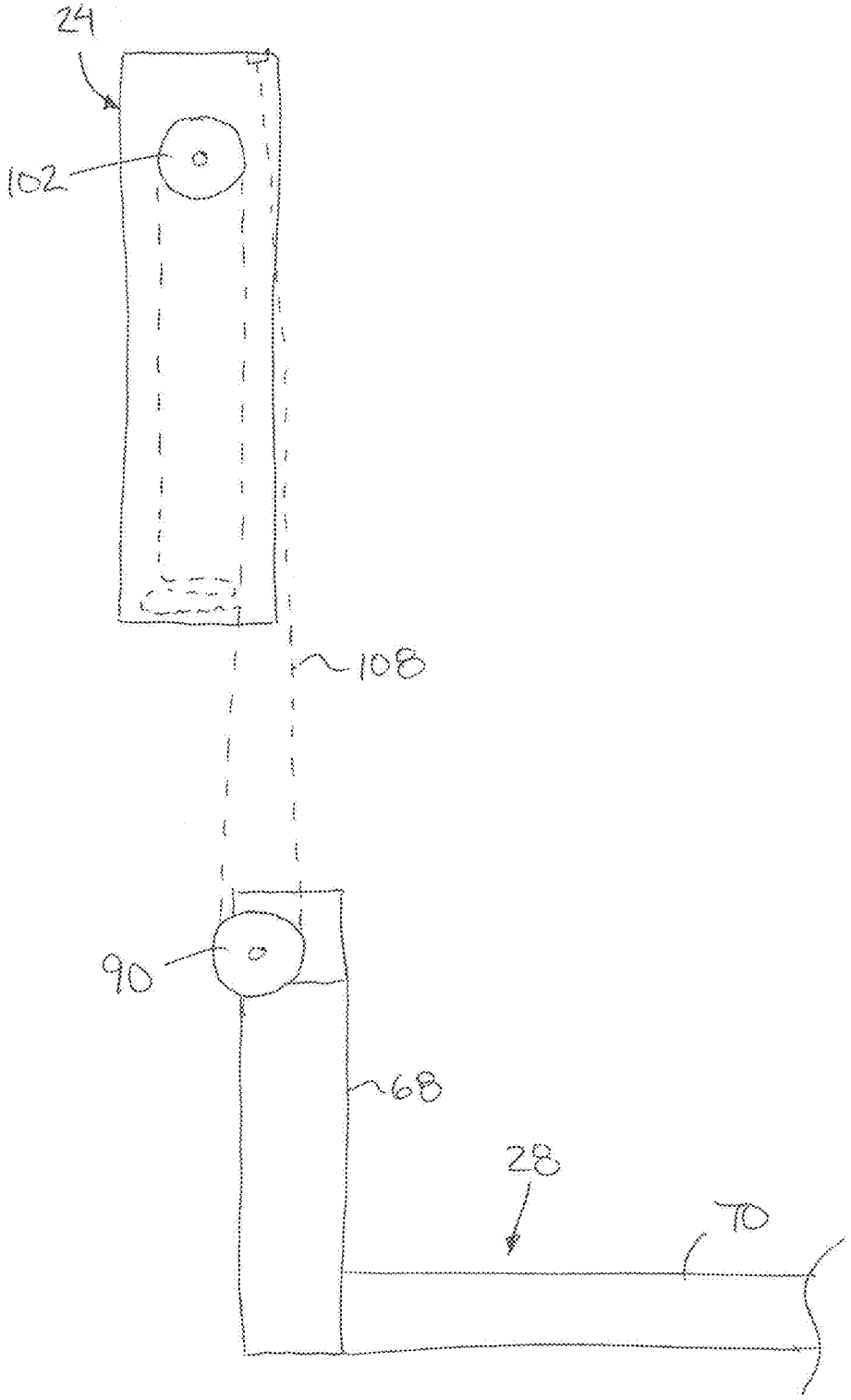
FIG. 20 is a schematic representation of the lift mechanism in the lowered position.
Figure 21:
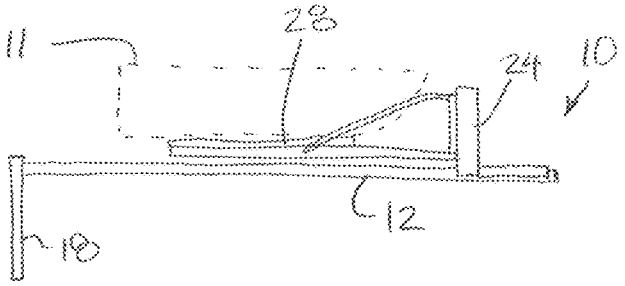
FIGS. 21, 22 and 23 schematically represent the boat handling apparatus and the stored position, the lifting and raised position, and the lifting and lowered position respectively.
Figure 22:
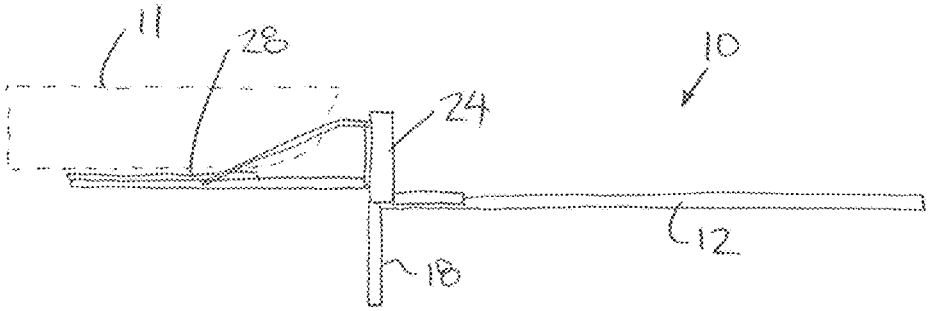
Figure 23:
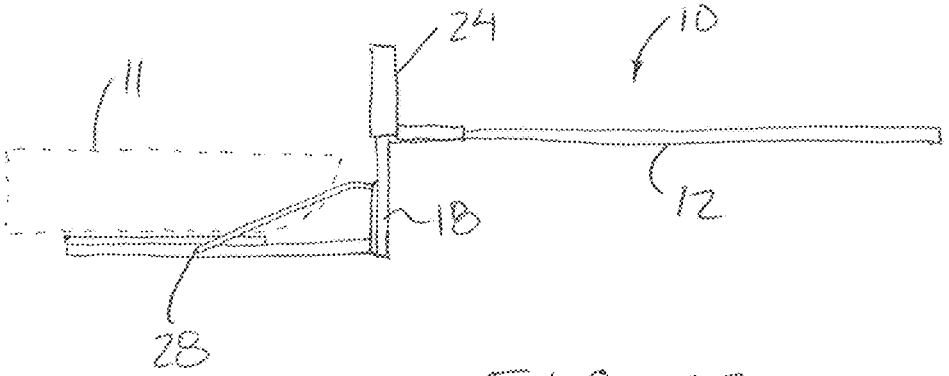

Referring to the accompanying figures there is illustrated a boat handling apparatus generally indicated by reference numeral 10. The apparatus 10 is suitable for both lifting a boat 11 out of a body of water and for moving the boat laterally away from the body of water.

The apparatus 10 generally includes i) a first track 12, and second track 18, a carriage frame 24, a third track 26 supported on the carriage frame, and a cradle frame 28.

The first track 12 extends generally horizontally in a longitudinal direction between a first end 14 and an opposing second end 16. The second track 18 extends generally vertically downward from a first end of the first track 12 between a top end 20 and a bottom and 22. The carriage frame 24 is supported for longitudinal rolling movement along the first track between a lifting position adjacent to the first end 14 of the first track and a stored position adjacent to the opposing second end of the first track. The third track 26 on the carriage frame 24 is vertically oriented and is arranged for alignment directly above the second track in the lifting position of the carriage frame.

The cradle frame 28 defines a cradle thereon upon which a boat is arranged to be supported such that the boat is movable with the cradle frame along the second track 18 from a lowered position at the bottom end of the second track upwardly towards a raised position on the third track by being transferable from the second track to the third track as the cradle frame is lifted towards the raised position. The cradle frame 28 is arranged to be fully supported on the carriage frame in the raised position, fully above the first track, such that the cradle frame is then movable with the carriage frame from the lifting position to the stored position along the first track.

Turning now more particularly to the first track 12, the first track 12 includes two rails 30 which are supported in parallel and spaced apart relationship by a plurality of crossbars 32 extending therebetween. Each rail comprises a C-shaped channel which is oriented to be open at a laterally outward sides thereof facing away from the opposing rail. The two rails 30 extend the full length of the first track in the longitudinal direction.

Turning now more particularly to the second track 18, the second track 18 similarly comprises two rails 34 which are mounted in fixed relation to be parallel and spaced apart from one another. The two rails 34 each comprise a C shaped channel; however, the open sides of the channels face laterally inwardly towards the opposing rail. The two rails 34 are fixed at the top end 20 thereof to the first end of the first track to depend vertically downward therefrom to the opposing bottom ends 22 of the second track. A crossbar 36 extends horizontally between the bottom ends of the two rails 34 for closing the bottom ends of the channels forming the rails 34. The top ends of the channels forming the two rails 34 remain open for communication with the third track 26 thereabove in the lifting position of the carriage frame as described in further detail below.

Two brace arms 38 assist in supporting the second track in fixed perpendicular relationship with the first track in the illustrated embodiment by mounting each brace arm at a bottom end of the brace arm in fixed relation to a respective one of the rails 34 of the second track spaced below the top end thereof and at a top end of the brace arm in fixed relation to a respective one of the rails 30 of the first track at a location spaced horizontally towards the second end of the first track. The brace arms 30 act as gussets for structural support between the first track and the second track.

Turning now more particularly to the carriage frame 24, the carriage frame 24 includes a lower frame 40, an intermediate frame 42 extending upwardly from the lower frame 40, and an upper frame 44 supported at a location spaced above the lower frame 40 by the intermediate frame 42.

The lower frame 40 is comprised of two beams 46 extending in the longitudinal direction of the first track at parallel and spaced apart locations so as to be wider than the spacing between the rails of the first track. The two beams 46 are thus positioned at laterally opposing outward sides of respective ones of the two rails 30 of the first track. Each beam 46 comprises a tubular member of rectangular cross section. Each beam 46 supports two carriage wheels 48 thereon at longitudinally spaced apart locations towards opposing ends of the beam at the inner side thereof. The carriage wheels 48 are rotatably supported on the beams and positioned laterally inwardly relative to the beams 46 such that the wheels are received internally within the C-shaped channels of the rails forming the first track. The wheels 48 are supported for rolling engagement within the respective rails of the track to support the carriage frame for rolling movement along the full length of the rails of the first track between the lifting and storage positions thereof.

The intermediate frame 42 comprises two side frame portions 50 in which each side frame portion consists of a single plate lying within a respective vertical plane which is parallel to the longitudinal direction. The two side frame portions 50 thus each lie within respective vertical planes which are parallel to one another and laterally spaced apart at opposing sides of the first track and at opposing sides of the carriage frame. The two side frame portions 50 of the intermediate frame are fixed to the first ends of the two beams 46, farthest from the second end of the first track.

The upper frame 44 locates the third track 26 thereon in the form of two upright rails 52 each comprised of a C shaped channel which is vertically oriented and which has an open side which faces laterally inwardly towards the opposing rail. The two rails 52 are parallel and spaced apart by the same distance as the two rails 34 of the second track therebelow and the bottom ends of the channels forming the two rails 52 remain open for alignment with and in open communication with the open top ends of the channels forming the rails 34 of the second track in the lifting position of the carriage frame. The two rails 52 are fixed at the bottom ends thereof onto respective ones of the two plates forming the side frame portions 50 of the intermediate frame to extend upwardly therefrom at laterally opposing sides of the carriage frame.

The carriage frame further includes a housing 54 surrounding the rails 52 of the third track and providing additional structural support to the upper frame 44. The housing includes two side plates 56 mounted parallel to the longitudinal direction at laterally opposing sides of the carriage frame to extend upwardly along the outer sides of the two rails 52 to span substantially the full height of the upper frame 44 of the carriage frame. A top plate 58 spends horizontally between the top ends of the two side plates to enclose the top end of the housing 54 and to provide additional structural support to the third track by being effectively connected between the top ends of the two rails 52.

An outer wall partially encloses the outer side of the housing 54 in a plane perpendicular to the longitudinal direction in the form of two panels 60 which are mounted within a common plane at laterally spaced apart locations to span the full height of the housing 54. A central slot 62 extends the full height of the housing between the two panels 60 at a laterally centred location within the carriage frame for communication of the lift mechanism of the cradle frame therethrough as described in further detail below. The outer lateral sides of the two panels 60 are sloped inwardly towards the opposing front side of the housing; however, there remains two side vertical slots 64 between each panel 60 and the respective adjacent side plate 56 of the housing to span the full height at the outer side of the housing alongside a respective rail of the third track 26. The side slots 64 allow for communication of a respective portion of the cradle frame therethrough is described in further detail below.

An inner side of the housing 54 which is perpendicular to the longitudinal direction is fully enclosed by an inner wall 66 in the form of a removable panel which encloses the inner side of the housing in the working configuration; however, the panel is readily removable for access to internal operating components for servicing and maintenance and the like. The internal components are described in further detail below.

The cradle frame 28 includes an upright frame portion 68 which is supported for rolling engagement along the second and third tracks of the apparatus, and a supporting portion 70 which extends horizontally outward from the bottom end of the upright frame portion 68 to define a cradle suitable for supporting a boat thereon. A boat is understood herein to comprise any form of watercraft including a single or double hull boat, a pontoon boat, various personal watercrafts, and the like.

The upright frame portion 68 is formed of two vertical posts 72, each formed of a respective plate, such that the posts 72 are mounted parallel and spaced apart from one another towards laterally opposing sides of the cradle frame. Two lift wheels 74 are supported at vertically spaced apart locations on each of the two vertical posts 72 to protrude laterally outward therefrom such that the lift wheels 74 are suitable for being received within the channels of the second track 18 and the third track 26 respectively. The channels 52 retain the lift wheels 74 therein to support the cradle frame in rolling engagement in a vertical direction along the second and third tracks while also readily enabling the cradle frame to be transferred between the second and third tracks due to the close proximity of and open communication between the top ends of the rails of the second track and the bottom ends of the rails of the third track thereabove.

The two vertical posts 72 are thus spaced apart by a suitable spacing to be received within the width between the rails of the second and third tracks. The plates forming the posts 72 also have sufficient depth in the longitudinal direction of the first track to enable the lift wheels 74 supported at the inner edge thereof to be received internally within the housing 54 within the third track, while the opposing outer edge of the plates forming the posts 72 protrude horizontally outward through respective ones of the side vertical slots 64 at the outer side of the housing 54 of the carriage frame for connection to the remainder of the cradle frame.

The cradle frame 28 also includes a top crossbar 76 connected between the top ends of the two vertical posts 72 while projecting laterally outward at both laterally opposing ends beyond the two posts 72 to be much wider in the lateral direction than the first and second tracks of the apparatus. A bottom crossbar 78 is also connected between the bottom ends of the two vertical posts 72 to provide structural integrity to the upright frame portion 68.

The supporting portion 70 of the cradle frame 28 includes two beams 80 which are parallel and spaced apart and which extend horizontally outward in the longitudinal direction away from the tracks of the apparatus from respective inner ends fixed at opposing ends of the bottom crossbar 78 to opposing free outer ends. Two brace arms 82 extend diagonally downward from respective top ends 84 at opposing ends of the top crossbar 76 to respective bottom ends which curve laterally inwardly for connection to respective ones of the beams 80 at a location spaced horizontally outward from the inner ends thereof. A plurality of crossbars 86 are also connected horizontally between the two beams 80 to provide additional structural support.

In the illustrated embodiment the cradle is provided by two skids 88 extending in the longitudinal direction and having upper supporting surfaces which are sloped downwardly and inwardly towards one another for mating with the shape of a corresponding boat hull supported thereon. In further embodiments the cradle may be of various shapes and forms for supporting different shapes of boat hulls thereon or other types of boat frames including pontoon boat frames, and various personal watercraft for example.

The lift mechanism which drives movement of the cradle frame between the lowered position on the second track and the raised position on the third track of the carriage frame includes a lower pulley wheel 90 which is supported on the top crossbar 76 at a laterally centred location on the cradle frame 28. Two support plates 92 are mounted on the top crossbar to be parallel and spaced apart from one another, parallel to the longitudinal direction of the first track, and vertical in orientation. The two plates 92 are spaced apart to receive the lower pulley wheel 90 rotatably therebetween on a respective axle which is mounted to span laterally between the two plates 92.

A lift motor 94 is supported within the housing 54 on the upper frame 44 of the carriage frame. A rotary output of the motor 94 is coupled to the input of a gearbox 96 which in turn outputs the rotation to an output gear 98. The output gear 98 transfers rotational drive to a drive shaft 100 supporting an upper pulley wheel 102 thereon using a driven gear 104 and a drive chain 106. The driven gear 104 and the upper pulley wheel 102 are mounted on the drive shaft 100 for rotation therewith about an axis of the drive shaft which is horizontally and laterally oriented in proximity to the top end of the carriage frame within the housing 54 of the carriage frame. The drive chain 106 comprises a fixed length loop of chain in meshing engagement about the driven gear 104 of the drive shaft and the output gear 98 of the gearbox such that the rotary output of the lift motor 94 results in rotation of the upper pulley wheel 102 on the drive shaft.

A retractable drive element 108 is operatively connected between the upper pulley wheel 102 and the lower pulley wheel 90. In the illustrated embodiment the retractable drive element 108 comprises a chain and the two pulley wheels 90 and 102 comprise chain hoisting pulley wheels which have suitably notched circumferential surfaces arranged for interlocking mating engagement with respective links of the chain forming the retractable drive element 108.

A first end of the chain 108 is fixed at a laterally centred location to the top end of the carriage frame. The chain is then looped downwardly from the first end thereof under the lower pulley wheel 90 on the cradle frame, and then subsequently looped over the upper pulley wheel 102 on the carriage frame. The opposing second end of the chain is freely suspended from the upper pulley wheel 102 and is permitted to collect within a suitable receptacle area within the bottom end of the housing 54 of the carriage frame. Rotation of the lift motor 94 in a first direction for lowering causes the chain 108 to be dispensed from the upper pulley wheel 102 to increase the overall length of the loop of chain extending downwardly from the upper pulley, around the free rotating lower pulley up to the first fixed end of the chain. As the length of chain between the upper pulley wheel and the first end of the chain is increased, the cradle frame which is suspended entirely by the chain is effectively lowered relative to the carriage frame from the raised position to the lowered position thereof.

Alternatively, rotating the lift motor in the opposing direction for raising, causes the chain 108 to be retracted by the upper pulley wheel 102 to shorten the loop of chain between the upper pulley wheel 102 and the first end of the chain which extends under the lower pulley wheel, thereby raising the lower pulley wheel up towards the upper pulley wheel until the raised position is reached at which point the lower pulley wheel is substantially directly against the upper pulley wheel. The two mounting plates 92 supporting the lower pulley wheel thereon and the chain 108 operatively connected between the pulley wheels communicate through the central vertical slot 62 at the outer wall of the housing 54.

A carriage drive mechanism for displacing the carriage between the lifting position and stored position thereof is provided by a carriage motor 110 which is also supported internally within the housing 54 of the carriage frame, towards the bottom end of the upper frame 44. The carriage motor 110 outputs drive to the input of a gearbox 112 which in turn outputs rotational drive to an output gear 114. The rotational drive is transferred from the output gear 114 to the drive shaft by a driven gear 118 mounted on the drive shaft for rotation therewith and a drive chain 120 comprising a fixed loop of chain in meshing engagement with both the output gear 114 of the gearbox and the driven gear 118 of the drive shaft.

The drive shaft 116 is supported for rotation about a respective axis which is horizontal and laterally oriented such that the drive shaft 116 spans substantially the full width of the carriage frame in the lateral direction between two opposing ends of the drive shaft supporting respective driving members 122 thereon. The driving members 122 each comprise a gear which is coupled to a respective one of the carriage wheels by a drive chain 124 and a driven gear 126. The driven gear 126 is coaxially mounted with the respective carriage wheel between the carriage wheel and the corresponding beam upon which the carriage wheel is supported such that the drive chain 124 comprising a fixed loop of chain is mounted in meshing engagement about the driven gear 126 and the corresponding driving member 122 of the drive shaft 116.

A chain opening 128 is provided in each of the two plates forming the side frame portions 50 of the intermediate frame 42 such that the drive chains 124 are fully received within the respective openings 128 to be coplanar with the respective plates of the side frame portions. The only components extending between the lower frame 40 of the carriage frame and the upper frame 44 of the carriage frame spaced above the lower frame 40, are accordingly the two side frame portions 50 and the two drive chains 124 which are fully contained within two respective planes which are longitudinally oriented so as to be very narrow in the lateral direction.

In one exemplary embodiment, the boat handling apparatus 10 may be used in combination with a horizontal supporting floor surface 140, for example the floor of a boat house, or any other suitable deck surface. Typically the deck surface is provided with two longitudinally extending slots positioned in alignment with respective rails of the first track 20 such that the first track and the lower frame of the carriage frame can be supported below the deck surface, while the upper frame and the cradle frame supported thereon can be located above the deck surface with the two side frame portions of the intermediate frame of the carriage frame extending upwardly through respective ones of the slots for longitudinally sliding movement therein as the carriage frame is displaced between the lifting and storage positions.

In one illustrated embodiment, the deck surface is formed of a plurality of deck boards 142 extending in the longitudinal direction of the first track while being spaced apart laterally from one another by respective gaps which are narrower in width than the deck boards themselves so as to define a plurality of longitudinally extending slots between adjacent ones of the deck boards. Two of the longitudinally extending slots between deck boards define the two longitudinal slots which receive the plates forming the two side frames of the intermediate frame of the carriage frame therein.

When loading a boat from the water, the carriage frame is positioned in the lifting position and the cradle frame is lowered to the lowered position at the bottom of the second track such that the cradle is below the upper surface of the water so as to permit a boat to be driven onto the cradle. The lift motor is then actuated to raise the cradle frame along the second track from the lowered position, upwardly towards the raised position by transferring the rolling movement of the cradle frame from the second track to the third track on the carriage frame. Once the cradle frame is in the raised position, fully supported on the carriage frame, fully above the first track in elevation as well as being fully above the deck surface, the carriage motor can then be actuated to displace the carriage frame with the cradle frame supported thereon horizontally along the first track from the lifting position towards the stored position. In the reverse operation, the carriage motor is first actuated to displace the carriage from the stored position to the lifting position, followed by actuation of the lift motor to lower the cradle frame from the third track on the carriage frame to the second track therebelow.

The overall height that the cradle frame can be raised and lowered is limited only by the length of the chain 108 and the length of the second track such that the cradle frame can be lifted over a considerable vertical distance including steep cliffs at a water shoreline which may be equivalent to several stories of a building in height for example. Likewise the horizontal distance that the boat is displaced along the first track is only limited by the length of the first track.

Although the second track is shown to be vertical and the first track is shown to be horizontal in the illustrated embodiment, in further embodiments, the second track may be supported at various slopes angularly offset from a vertical orientation while still accomplishing the purpose of providing some vertical lift, while the first track may be supported at various slopes angularly offset from a horizontal orientation, including ramped sections or curved sections for example while still accomplishing the purpose of providing some horizontal translation.

Since various modifications can be made in my invention as herein above described, it is intended that all matter contained in the accompanying specification shall be interpreted as illustrative only and not in a limiting sense.

The invention claimed is:

1. A boat handling apparatus comprising:

a first track extending in a longitudinal direction between a first end and a second end which is spaced apart in a horizontal direction from the first end;

a carriage frame supported on the first track so as to be movable along the first track in the longitudinal direction between a lifting position adjacent to the first end and a stored position spaced along the first track from the first end of the first track;

a second track which is upright in orientation and which is supported in proximity to the first end of the first track so as to extend downwardly from the first track in fixed relation to the first track;

a third track supported on the carriage frame in an upright orientation so as to be movable along the first track together with the carriage frame;

the third track being in alignment with the second track in the lifting position of the carriage frame; and a cradle frame arranged to support a boat thereon, the cradle frame being supported on the third track on the carriage frame in the stored position of the carriage frame along the first track;

in the lifting position of the carriage frame, the cradle frame being movable along the second track and the third track such that the cradle frame is transferrable from the second track to the third track on the carriage frame from a lowered position on the second track spaced below the third track on the carriage frame to a raised position supported on the third track on the carriage frame above the second track.

2. The apparatus according to claim 1 further comprising a retractable drive element coupled between the cradle frame and the carriage frame to suspend the cradle frame from the carriage frame in the lower position of the cradle frame on the second track.

3. The apparatus according to claim 2 further comprising a lift motor supported on the carriage frame and operatively connected to the retractable drive element so as to raise and lower the cradle frame along the second track by retracting the retractable drive element.

4. The apparatus according to claim 1 wherein the cradle frame comprises an upright frame portion supporting lift wheels thereon in rolling engagement along the second track and a supporting portion extending horizontally outwardly from the upright frame portion, away from the first track, in proximity to a bottom end of the upright frame portion, the supporting portion defining a cradle arranged to support a boat thereon.

5. The apparatus according to claim 1 further comprising carriage wheels supported on the carriage frame in rolling engagement along the first track and a carriage motor supported on the carriage frame which is operatively connected to at least one of the carriage wheels so as to displace the carriage frame along the first track by driving rotation of said at least one of the carriage wheels.

6. The apparatus according to claim 5 further comprising a drive shaft supported on the carriage frame so as to be driven to rotate by the carriage motor and a pair of laterally spaced apart driving members supported on the drive shaft for rotation with the shaft relative to the carriage frame, the driving members being operatively connected to respective ones of the carriage wheels at laterally opposing sides of the carriage frame.

7. The apparatus according to claim 1 wherein the carriage frame further comprises:

a lower frame supporting carriage wheels thereon in rolling engagement along the first track;

an upper frame arranged to receive the cradle frame supported thereon in the raised position; and an intermediate frame supporting the upper frame spaced above the lower frame, the intermediate frame comprising two laterally spaced apart side frame portions, each side frame portion lying substantially in a respective upright plane which is parallel to the longitudinal direction of the first track.

8. The apparatus according to claim 7 wherein the intermediate frame consists solely of the two side frame portions, each side frame portion consisting of a plate member which is upright and parallel to the longitudinal direction of the first track.

9. The apparatus according to claim 7 further comprising a carriage motor supported on the upper frame of the carriage frame which is operatively connected to at least one of the carriage wheels so as to displace the carriage frame along the first track by driving rotation of said at least one of the carriage wheels.

10. The apparatus according to claim 9 wherein the carriage motor is operatively connected to said at least one of the carriage wheels by a chain which is supported to be co-planar with one of the side frame portions.

11. The apparatus according to claim 7 in combination with a deck surface comprising a plurality of deck boards extending in the longitudinal direction above the first track so as to define a longitudinally extending slot in the deck surface between each pair of the deck boards that are adjacent one another, wherein the lower frame is below the deck surface, the upper frame is above the deck surface and the side frame portions of the intermediate frame extend upwardly from the lower frame to the upper frame through respective ones of the longitudinally extending slots in the deck surface.

12. A boat handling apparatus comprising:

a main track extending in a longitudinal direction between a first end and a second end which is spaced apart in a horizontal direction from the first end;

a supporting floor surface supported above the main track and locating a pair of longitudinal slots therein extending in the longitudinal direction along a length of the main track at laterally spaced apart locations; and a carriage frame supported on the main track so as to be movable along the main track in the longitudinal direction between a first position adjacent to the first end and a second position spaced along the main track from the first end of the main track;

the carriage frame further comprising:

a lower frame below the supporting floor surface supporting carriage wheels thereon in rolling engagement along the main track;

an upper frame above the supporting floor surface and supporting a cradle frame thereon which is arranged to support a boat thereon; and an intermediate frame supporting the upper frame spaced above the lower frame, the intermediate frame comprising two laterally spaced apart side frame portions extending upwardly through respective ones of the longitudinal slots in the floor supporting surface for sliding movement along the longitudinal slots between the first and second positions of the carriage frame along the track.

13. The apparatus according to claim 12 wherein the intermediate frame consists solely of the two side frame portions, each side frame portion consisting of a plate member which is upright and parallel to the longitudinal direction of the main track.

14. The apparatus according to claim 12 further comprising a carriage motor supported on the upper frame of the carriage frame which is operatively connected to at least one of the carriage wheels so as to displace the carriage frame along the main track by driving rotation of said at least one of the carriage wheels.

15. The apparatus according to claim 14 wherein the carriage motor is operatively connected to said at least one of the carriage wheels by a chain which is supported to be co-planar with one of the side frame portions.

16. The apparatus according to claim 12 wherein the supporting floor surface comprises a deck surface formed of a plurality of deck boards extending in the longitudinal direction above the main track so as to define a longitudinally extending slot in the deck surface between each pair of the deck boards that are adjacent one another, wherein the lower frame is below the deck surface, the upper frame is above the deck surface and the side frame portions of the intermediate frame extend upwardly from the lower frame to the upper frame through respective ones of the longitudinally extending slots in the deck surface.

* * * * *